United States Patent [19]

Dugge et al.

[11] 4,165,820

[45] Aug. 28, 1979

[54] AERATOR CONTROL ARRANGEMENT

[75] Inventors: Richard H. Dugge, Lafayette Township, St. Louis County; Dallas W. Rollins, St. Charles, both of Mo.

[73] Assignee: ACF Industries, Incorporated, New York, N.Y.

[21] Appl. No.: 545,260

[22] Filed: Jan. 29, 1975

[51] Int. Cl.[2] ..... B65G 3/12

[52] U.S. Cl. ..... 222/70; 222/195; 406/85; 406/137

[58] Field of Search ..... 222/195, 70; 302/52, 302/53, 42, 26; 259/DIG. 17

[56] References Cited

U.S. PATENT DOCUMENTS

| | | | |
|---|---|---|---|
| 3,246,805 | 4/1966 | Kemp | 222/195 |
| 3,249,263 | 5/1966 | Howard | 222/195 |
| 3,366,282 | 1/1968 | Lucas | 222/195 |
| 3,578,216 | 5/1971 | Pearson | 222/195 |
| 3,788,527 | 1/1974 | Matson | 222/195 |
| 3,881,702 | 5/1975 | McIver | 259/DIG. 17 |
| 3,942,689 | 3/1976 | Dakin et al. | 222/195 |
| 4,051,982 | 10/1977 | Stetson | 222/195 |

FOREIGN PATENT DOCUMENTS

| | | | |
|---|---|---|---|
| 1934747 | 1/1970 | Fed. Rep. of Germany | 222/195 |
| 1303262 | 1/1973 | United Kingdom | 222/195 |

OTHER PUBLICATIONS

*Martin News*, vol. 1, No. 15, 1971.

*Primary Examiner*—Robert J. Spar
*Assistant Examiner*—Frederick R. Handren
*Attorney, Agent, or Firm*—Henry W. Cummings

[57] ABSTRACT

A control arrangement is provided to control discharges of compressed gas into vessels containing difficult to unload material comprising one or more control valves connected in operative relation to discharge valves operative to discharge compressed gas from an accumulator into the vessel. The control valves are provided with a timer for controlling the time of discharge of compressed gas from the accumulator. This timer may comprise a pneumatic, electro-mechanism and/or electronic timer. The control arrangement may also include means for applying pressure gas to discharge valves which are in operative relation with accumulator discharge devices which are not being utilized for unloading. Various arrangements for mounting the accumulators, discharge valves, conduits, and discharge devices are illustrated in connection with a railway hopper car. Certain discharge device mounting arrangements are preferred in unloading certain types of lading.

43 Claims, 12 Drawing Figures

AERATOR CONTROL ARRANGEMENT

BACKGROUND OF THE INVENTION

In U.S. Pat. No. 3,788,527 issued July 30, 1974 there is disclosed a quick release aerator that stores a large volume of gas under significant pressure and then releases the gas into a storage vessel, producing a blast of gas which dislodges stuck or bridged material to be unloaded from the vessel. While this device is quite effective in dislodging and loosening clogged and/or bridged lading, it often requires a plurality of such aerators to be mounted on the vessel so that gas discharged from the aerators reaches into most, if not all parts of the vessel. Thus in many instances a number of aerators are required for each vessel to be unloaded.

In U.S. Pat. No. 3,958,722 a self indexing elbow discharge device is disclosed which may be utilized with a source of high pressure gas such as an accumulator and discharge valve means for timed release of this pressurized gas. The self indexing elbow rotates upon discharge of a blast of gas from the discharge end of the elbow so that after several discharges a large volume of the storage vessel comes under action of the blast. Thus through the use of the self indexing elbow described in U.S. Pat. No. 3,958,722 fewer discharge valves, discharge devices and associated conduits are required to dislodge bridged and/or clogged lading.

However, a problem exists as to how to control the operation of these discharge valves when a plurality of gas discharge devices are affixed to a vessel and particularly when a plurality of accumulators are provided, each having discharge valves and discharge devices mounted on a plurality of vessels in operative relation an accumulator. A particular example of this problem is found in connection with a railway hopper car. Most railway hopper cars comprise a plurality of hoppers, each of which is unloaded separately.

However, similar problems exist in unloading one or a plurality of static vessels including but not limited to industrial bins.

SUMMARY OF THE INVENTION

It is an object of the present invention to provide an arrangement for controlling the operation of aerators utilized to facilitate unloading of difficult to unload material from vessels.

Another object of the present invention is to provide such a control arrangement which is easy to operate.

Another object of the present invention is to provide such a control arrangement which is inexpensive to manufacture.

Another object of the present invention is to provide a vessel having aerators mounted thereon and a control arrangement therefor to facilitate unloading of difficult to unload lading therefrom.

Another object of the present invention is to provide a railway hopper car having aerators mounted thereon and a control arrangement therefor to facilitate unloading of difficult to unload lading therefrom.

Another object of the present invention is to provide a control arrangement for operation of aerators mounted on a hopper car.

Another object of the present invention is to provide mounting arrangements for discharge devices which are particularly suited to certain types of ladings.

A control arrangement is provided to control discharges of compressd gas to vessels containing difficult to unload material comprising one or a plurality of control valves, each connected in operative relation to discharge valves operative to discharge compressed gas from an accumulator. These control valves are provided with time control means for controlling the time of discharge of compressed gas from the accumulator. This time control means may comprise pneumatic, electro-mechanical and/or electric timers. The control arrangement may also include means for applying pressure gas to discharge valves which are in operative relation with accumulator discharge devices which are not being utilized for unloading. One accumulator may service more than one discharge device if the control arrangement provides sufficient time to pressurize the accumulator after discharge from each discharge device, and controls the time sequence of discharge from the various discharge devices. Various arrangements for mounting the accumulators, discharge valves, conduits, and discharge devices are illustrated in connection with a railway hopper car. Certain discharge devices mounting arrangements are preferred for unloading certain types of lading.

THE DRAWINGS

DETAILED DESCRIPTION

The present invention is applicable to fixed industrial bins and to many other applications wherein one or a plurality of vessels provided generally in adjacent physical proximity, contain a difficult to unload lading. However, the present invention will be described in connection with a railway hopper car to which the control arrangement of the present invention is particularly adaptable.

Figure 2:
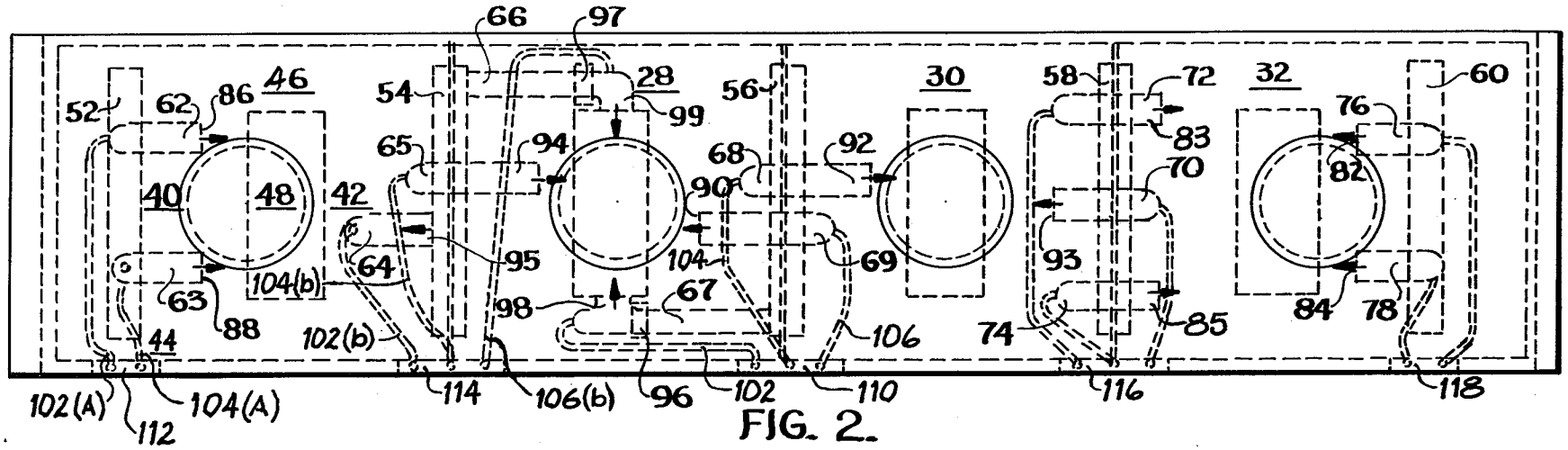
FIG. 2 is a top view of the railway car and aerators control arrangements illustrated in FIG. 1.
Figure 1:
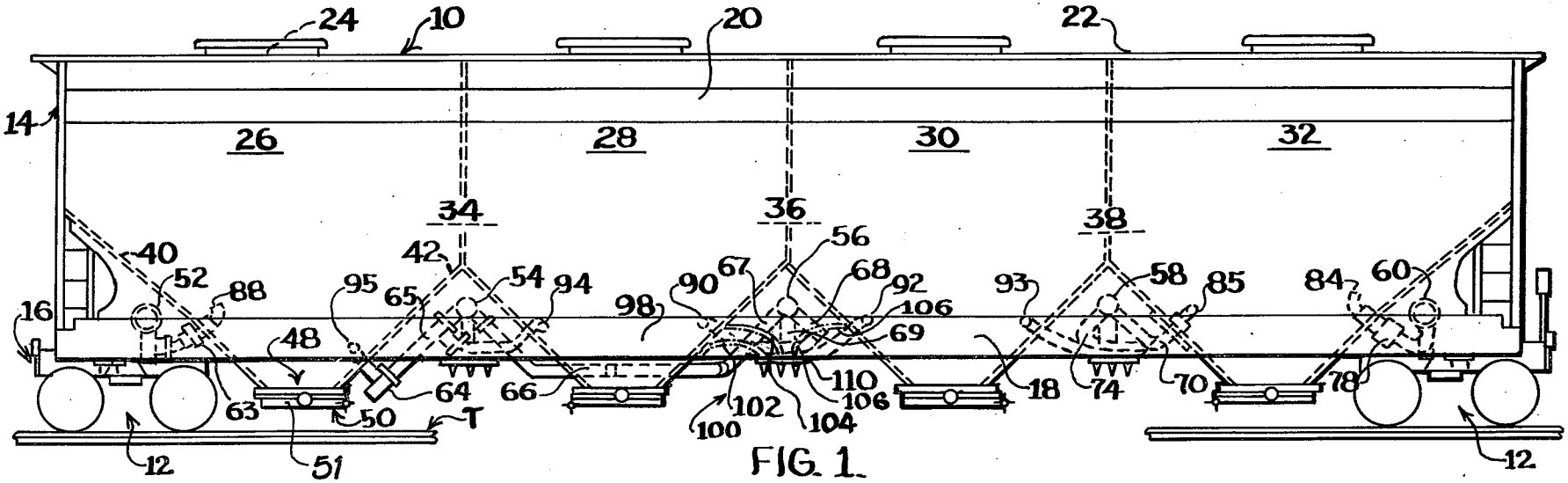
FIG. 1 is a side view of a railway car illustrating several alternative arrangements for mounting aerators thereon according to the present invention, and illustrating the aerator control arrangement of the present invention.

Therefore, in FIGS. 1 and 2 a railway hopper car is indicated generally at 10 comprising suitable trucks 12 which support the car for travel along a railway track T, conventional end support structure 14, and conventional coupler structure 16 which is known in the art. A side sill 18 and a top chord 20 carry longitudinal loads and a roof 22 is provided containing a plurality of hatch openings 24 for loading the car. The car is also provided with a plurality of hoppers 26, 28, 30 and 32. More or less hoppers may be provided on the car as desired. In the embodiment shown in FIG. 1 the hoppers are joined together by transverse bulkheads 34, 36 and 38. Each hopper is provided with slope sheets 40, 42, 44 and 46 which are inclinded downwardly towards an outlet opening 48 which is provided with an outlet 50 which may be any of the known types such as gravity, pneumatic or gravity-pneumatic. By way of example, a conventional gravity outlet 51 is illustrated which is movable horizontally with respect to the opening 48.

With ladings which are not difficult to unload the lading flows by gravity downwardly along the slope sheets 40, 42, 44, and 46 and is readily discharged through the outlet 50 with or without a pneumatic assist.

However, some ladings tend to clog or bridge and thus do not unload due to the force of gravity. It is necessary to provide some means for breaking up and dislodging the clogging and bridging which takes place with regard to these ladings.

As is disclosed in application Ser. No. 525,492, now U.S. Pat. No. 3,958,722, this may comprise one or more aerators including one or more accumulators with one or more discharge valves mounted in operative relation thereto, and one or more gas discharge devices to direct a blast of gas into the vessel or hopper. A plurality of accumulators 52, 54, 56, 58, and 60 are shown mounted below hoppers 26, 28, 30, and 3. Each of the accumulators are provided with one or more discharge valves illustrated in the drawings at 62–70, 72, 74, 76, and 78. Discharge devices 82–86 and 88 direct the blast of gas into the hopper along the center line of the conduit, longitudinally of the hoppers. Self indexing elbows as described in application Ser. No. 525,492, now U.S. Pat. No. 3,958,722, illustrated at 90, 92, 93 and 94 are utilized in operative relation with discharge valves 69, 68, 70 and 65 respectively. Furthermore, a manually indexing elbow is mounted in operative relation with discharge valve 64 as indicated at 95 in the drawings. It will also be apparent that the valves 96 and 97 (connected respectively to accumulators 54 and 56 by conduits 66 and 67 running along the side of the car) and discharge devices 98 and 99 will direct a blast of air transversely of the hoppers into the outlet portion of the outlet.

It is apparent that a wide variety of aerator arrangements may be utilized on a railway hopper car or other vessel(s) which contain a lading difficult to unload. Discharge conduits which simply discharge directly into the hopper may be used. Self indexing elbow arrangements may be used. Manually rotatable elbows may be used. The blast may be applied longitudinally or transversely of the hopper.

A source of compressed gas is required for the operation of discharge valves 62–70, 72, 74, 76 and 78. The most convenient source to be utilized in most situations is compressed air, particularly shop air which is available at most loading and unloading sites.

Figure 9:
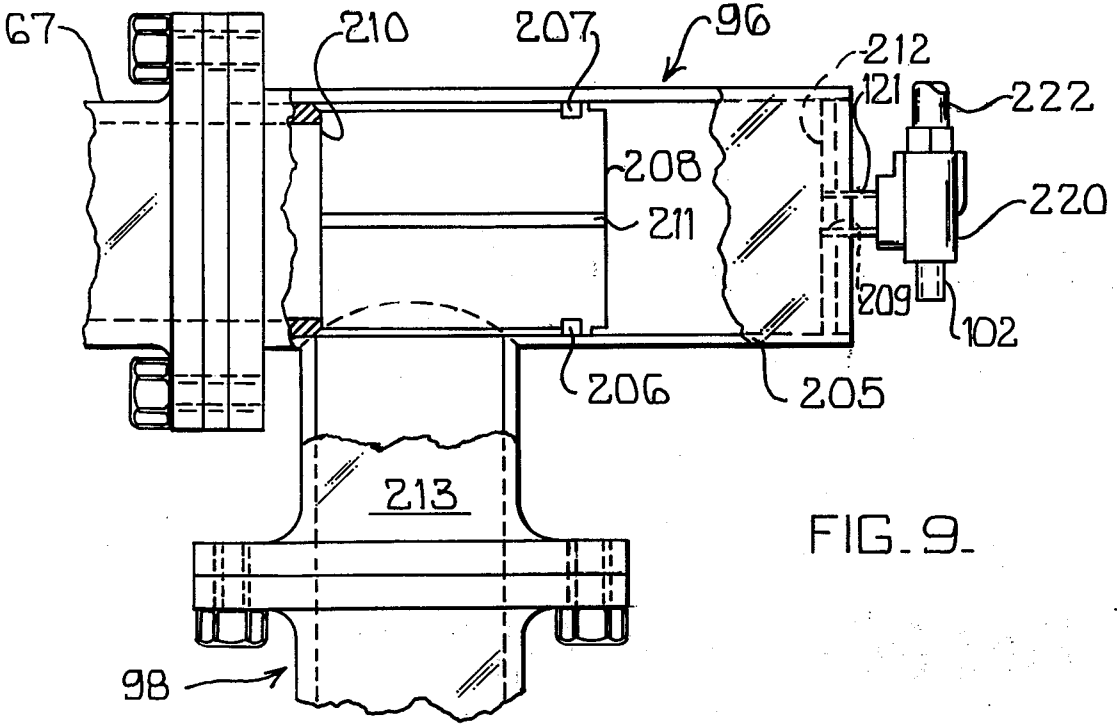
FIG. 9 is a sectional view of an accumulator discharge valve which may be used in the present invention.

One of thee discharge valves 96 is shown in FIG. 9. Compressed air is supplied from conduit 102 through port 209 into cylinder 205 forcing piston 208 against seat 210. A recess 206 is provided in piston 208 into which is placed a sealing member such as O-ring 207. Compressed air flows through port 211 into conduit 67 thereby charging accumulator 56 to desired pressure. A quick release valve 220 connected to cylinder 205 is actuated to cause a reduction in pressure at port 209. Then the pressure in accumulator causes piston 208 to rapidly move back against surface 212 allowing gas very rapidly to escape out port 213 into transverse discharge device 98. Valve 220 is automatically actuated by the control system of the present invention. Valve 220 may be provided with a muffler 222 to reduce the noise level of exhausting gas through valve 220.

An important feature of the present invention comprises a control arrangement for discharging a blast of gas from one or more discharge devices while avoiding the discharge of a blast of gas from selected other discharge devices.

As is described in U.S. Pat. No. 3,958,722 discharge valves mounted in operative relation to an accumulator are utilized to pressurize the accumulator and provide for a timed release of gas from the accumulator in the form of a blast. Thus, each of the discharge valves 62, 70, 72, 74, 76, and 78 is provided with a gas inlet to effect pressurization of the accumulators respectively in communication with the discharge valves.

The control arrangement of the present invention is indicated generally at 100. Each discharge valve is provided with its own supply of compressed gas and has its own gas inlet indicated at 102 for valve 67, 104 for valve 68 and 106 for valve 69. It is convenient to run the gas inlets 102, 104, 106 for a given area to a common header indicated at 110. The discharge valves in the remaining areas of the car are provided with gas inlet conduits, each of which is connected to an appropriate header 112, 114, 116 and 118 (FIG. 2) for the various areas of the car.

Figure 3:
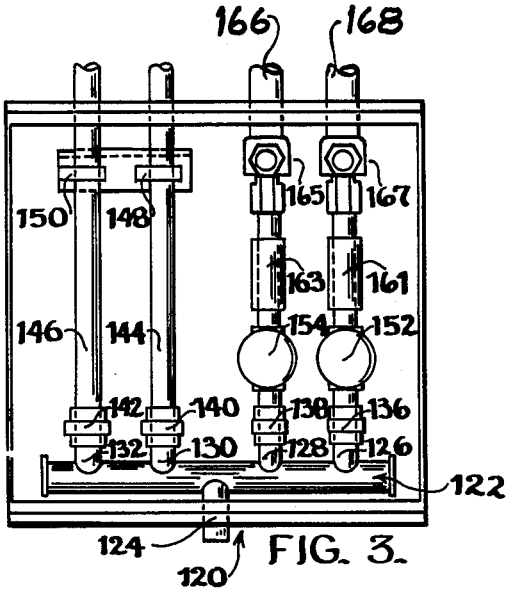
FIG. 3 is a schematic plan view of a control box which may be utilized in the aerator control system of the present invention.

It is also convenient (although not essential) to provide a control box indicated generally at 120 (FIG. 3) perferably comprising an inlet manifold 122 having a gas inlet 124 and a plurality of outlets 126, 128, 130, and 132. These outlets may be provided with suitable couplings 136, 138, and 142. Outlets 130 and 132 are provided with suitable conduits 144 and 146 which are held in place with appropriate brackets or clamps 148 and 150. Conduits 144 and 146 are adapted to be connected to respective gas inlet conduits 102, 104, 106, as the occasion may arise at headers 110 112, 114, 116 and 118.

Figure 3A:
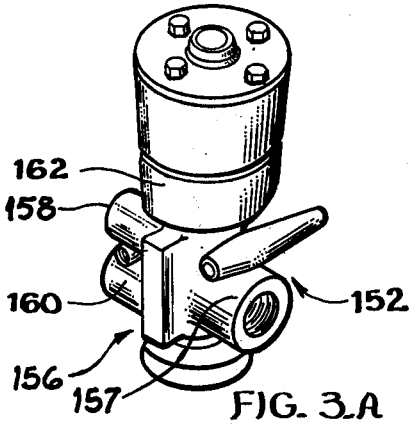
FIG. 3A is a perspective view of the control valve assembly of the present invention.

Outlets 126 and 128 are provided with control valve assemblies 152 and 154 which are utilized to cycle the accumulator discharge valves. These assemblies 152 and 154 may be provided with suitable support brackets (not shown). As shown in FIG. 3A, valve assemblies 152 and 154 in general comprise two elements, a control valve 156 and a timer 162. Control valve 156 may be any suitable three-way valve having an inlet 157 and a pair of outlets 158 and 160, one of which is open to the atmosphere. Valve 156 may be either normally closed or normally open and may be equipped with pneumatic and/or solenoid operators, for which there are many on the market. The solenoid operators may be actuated by either electronic or electro-mechanical timers.

An example of a suitable three way valve which may be utilized is an Norgren valve No. D1023B-00-Al equipped with a pneumatic operator as disclosed in the catalog entitled *Pneumatic Products* No. NC 41, copyright 1973 by C. A. Norgren Co., 5400 S. Delaware St., Littleton, Colo. 80120, p. 27 thereof; or a Skinner valve New Briton, Conn. 06050 No. LP5DB5150 equipped with a solenoid operator, as shown on page 17 of the catalogue *Skinner Valves* Condensed Catalogue-VC-74 copyright 1974).

Timer 162 may be either a pneumatic type, electromechanical or of the entirely electronic type.

In general, a pneumatic timer with about a 0–60 sec. time delay which will provide a pneumatic signal for a piloted, air actuated, 3-way valve operating in a pressure range from 20 to 150 psig, such as a Norgren No. D1023B-00-Al-01, shown on pages 27 and 31 in the above catalog may be used.

Electro-mechanical timers usually comprise a bank of cams driven by a synchronous motor. In general, there will be one cam set for each solenoid valve with one revolution of the cam being equal to the total time cycle. An example is found in *Automatic Timing Controls Co.* catalogue No. T-100 (King of Prussia, Pennsylvania, 19406) series 2300B, dated June 1974.

In general, repeat cycle electronic timers which incorporate time setting of approx. 0–60 for both on and off conditions of the cycle may be used. The timer may have an electrical rating of either 110 volt and 50/60 HZ, 220 volt, 50/60 HZ or whatever is required to meet the given power source.

A suitable transistorized or electronic timer may be the Eagle Signal DG160A6 containing a contact rating of 10 amps. at 120 AC or 5 amps. at 240 volts AC.

A time delay relay with an adjustable time delay of approx. 0–60 sec. is used to adjust the time delay between the two continuous cycle timers. An example of such a device is an Eagle Signal CG60A6 time delay relay.

These valves and timers are commercial items and it will be apparent to those skilled in the art that a wide variety of those now on the market are suitable for this purpose.

One of the outlets 158 or 160 in valve assemblies 152 and 154 is vented to the atmosphere and the other is then connected by suitable couplings 161 and 163 respectively to quick release valves 165 and 167. Quick release valves 165 and 167 generally comprise a housing with a floating rubber diaphragm or piston. The piston is arranged so that when air is being supplied to the valve inlet air flow is diverted to the outlet. When air pressure is removed from the inlet, back pressure in the outlet line forces the piston back, permitting the air to be exhausted out the exhaust port. An example is a Humphrey quick exhaust valve No. QE5, found in *Humphrey Air Central Specialist;* catalog 75, (undated), Humphrey Products, P.O. Box 2008, Kalamazoo, Michigan 49003 (p. 5).

When valve 156 is vented to the atmosphere by timer 162, quick release valves 165 and 167 drop the pressure in the respective lines 166 and 168 from the control box to header 110 and/or the discharge valve in communication with the accumulators. When quick release valves shown at 220 in FIG. 9 are also provided as a part of, or integral with, the discharge valves, it has been found that the cycling is more effective, particularly where long pressure lines extend from the control box to the discharge valves, to provide quick release valves in the control box.

Figure 4:
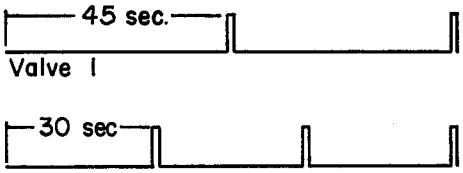
FIG. 4 is a schematic view illustrating the time discharge cycle of the aerator control arrangement of the present invention when pneumatic timer is utilized.

For example, accumulator 56 may be utilized for discharges. For example, if control assembly 152 is set on a 45 second discharge cycle as shown in FIG. 4, conduit 168 will be connected to conduit 106 at header 110, and discharge valve 69 will cause accumulator 56 to discharge through self indexing elbow 90 every 45 seconds. Similarly, control assembly 154 will be connected through conduit 166, header 110 and conduit 104 to cause a discharge through discharge valve 68 and elbow 92 every 30 seconds. At about the third discharge of elbow 90 and the second discharge of elbow 92 one or the other of these discharges will be significantly greater. However, the fact that one discharge is of reduced magnitude does not significantly reduce the effectiveness of the dislodging process.

Figure 5:
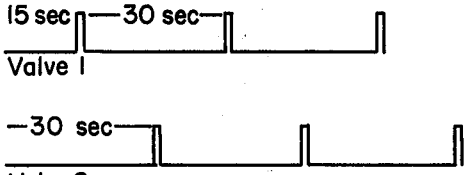
FIG. 5 is a schematic view illustrating the time discharge cycle of the aerator control arrangement of the present invention when an electronic timer is utilized.

Electronic timers have the advantage that they can be set to cycle for alternate even periods, for example, every 30 seconds. Thus, as shown in FIG. 5 control assembly 152, by connection of conduit 168 to header 112 and gas inlet conduit **104*a* may be utilized to cause a discharge every 30 seconds from accumulator 52 through discharge valve 63 and conduit 88, and control assembly 154 by connection of conduit 166 to header 112 and gas inlet conduit 102*a* may be utilized to cause a discharge every 30 seconds through valve 62 and discharge conduit 86. Thus a discharge from accumulator 52** occurs every 15 seconds.

Conduits 144 and 146 are utilized to maintain gas pressure on discharge valves connected to discharge devices in hoppers not being unloaded to prevent the accumulator from discharging through such discharge devices. For example, when hopper 28 is being unloaded and rotating elbow 90 and conduit 98 are being discharged by means of accumulator 56, one of lines 144 and 146 will be connected to header 110 and gas inlet 104 to prevent the accumulator discharging rotating elbow 92 in hopper 30. The other of conduits 144 and 146 from the same or from another control box would be connected to header 114 and gas inlet conduit **104*b* to prevent accumulator 54 from discharging from manual elbow 95 in hopper 26 so that only rotating elbow 94 and conduit 99 would discharge from accumulator 54**.

Preferably, when, for example, hopper 28 is being unloaded both accumulators 54 and 56 are utilized and discharges are occuring through rotating elbow 90 and conduit 98 from accumulator 56, and from rotating elbow 94 and conduit 99 from accumulator 54. Accumulators 54 and 52 would be utilized to unload hopper 26 to provide discharge respectively from manually rotatable elbow 95 and discharge conduits 86 and 88. Accumulators 56 and 58 would be utilized to unload hopper 30, by discharging respectively through self-indexing elbows 92 and 93 and accumulators 58 and 60 would be utilized to unload hopper 32, by respectively discharging through conduits 83 and 85, and 82 and 84.

It will be apparent that it will require one or two control boxes to control the discharge from a given hopper, depending on the number of discharge devices per hopper and the number of control assemblies 152 and 154 and the number of pressure conduits of the type of 144 and 146, per control box. This may vary as desired and as is convenient for particular unloading site arrangements. If in certain instances it is desired to inload more than one hopper at a time, then more control assemblies and pressure conduits would be required to unload two hoppers simultaneously.

It will be apparent that for static bin applications whether one or more control boxes will be required will depend upon the number of control assemblies and pressure lines per control box and where and how many discharge devices are mounted on the bins.

Figure 6:
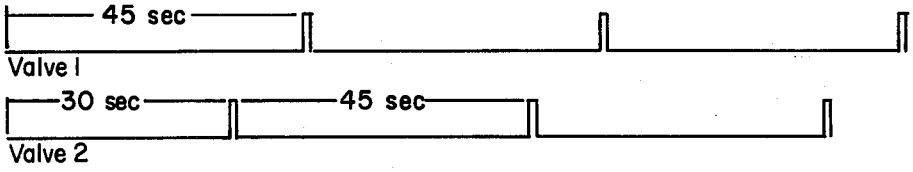
FIG. 6 is a schematic view illustrating the time discharge cycle of the aerator control arrangement of the present invention illustrating cycling three discharge devices per accumulator.
Figure 7:
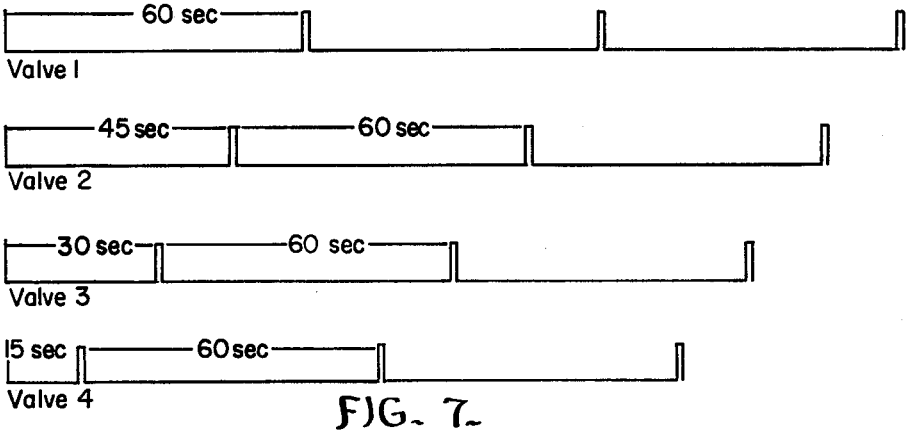
FIG. 7 is a schematic view illustrating the time discharge cycle of the aerator control arrangement of the present invention illustrating cycling four discharge devices per accumulator.

It is within the scope of the present invention to provide simultaneous cycling for more than two discharge devices for a given accumulator. Thus, in FIGS. 6 and 7, three and four member discharge cycles per accumulator are shown by way of example.

It will also be apparent that the control arrangement of the present invention could be utilized to allow cycling of only one discharge device and block discharge from one or more discharge valves. The control arrangement of the present invention may be provided with as many pressure conduits as desired and as many control assemblies as desired so long as appropriate cycling patterns are utilized for the associated assumulators and discharge valves. The control assemblies and pressure conduits may be mounted in one or a plurality of control boxes.

In accordance with the present invention it has been found that it is advantageous to place certain discharge devices in certain locations to facilitate the unloading of certain lading. For example, for unloading a particulate material which fluidizes at least to some extent in the lower hopper cavity, near the outlet, it is preferred to provide a self indexing elbow on at least one and preferably both slope sheets, preferably about one-third to two-thirds of the way up the sloping portion of the slope sheet. See, for example, self indexing elbows 92 and 93 in hopper 30 in FIGS. 1 and 2.

This arrangement is utilized for materials (usually powders) which have a very low flowability but are affected to some degree by fluidization. Examples of such materials include wood flour, precipitated calcium carbonate, clay, talc, diatomaceous earth and plastic plasticizers. These materials exhibit severe bridging tendencies. However, fluidization will normally permit a void to develop directly over the outlet or in the bottom of the hopper. For this condition the pressures exerted by the blasters will cause material to collapse into the void. The self rotating feature of the elbow will cause the blast to be diverted to substantially all portions of the slope sheet which will knock down material hung-up on the slope sheet or in the valley angles (junction of side sheets and transverse slope sheets).

In handling a granular material not significantly affected by fluidization it is preferred to provide at least one manual elbow low down on the slope sheet (on the lower third of the slope sheet) which can be aimed at the outlet. Note manual elbow 95 in the lower portion of hopper 26. Perferably one such manual elbow is provided on each slope sheet.

This arrangement is used for ladings which are usually granular and are not affected by fluidization. Examples include film scrap, crumb rubber, polyvinyl chloride pellets and wood chips. Because of their geometric shape the particles interlock, permitting the lading to develop a large shearing stress, which often results in severe bridging directly over the outlet discharge opening. A manual elbow is used so that the blast can be repeatedly directed down toward the outlet discharge opening until the lading beneath the elbow is blasted away. The elbow may then be rotated to direct the blast up at the bottom surface of the arch which will permit material to be blasted away until the bridge collapses.

Figure 8B:
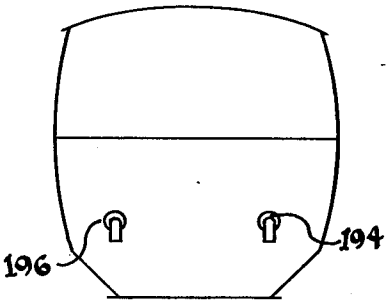
FIG. 8B is a sectional view along the lines 8B—8B in FIG. 8.
Figure 8:
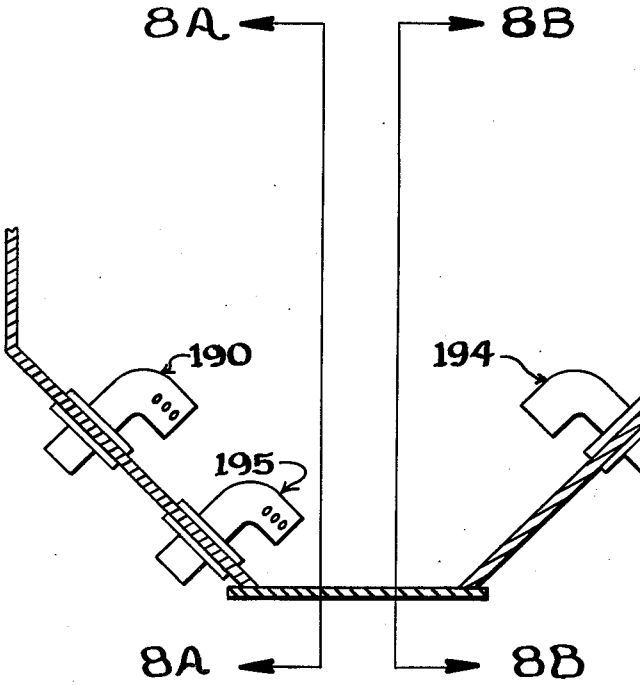
FIG. 8 is a transverse sectional view of a hopper illustrating a discharge device mounting arrangement for a particularly difficult to unload type of lading.
Figure 8A:
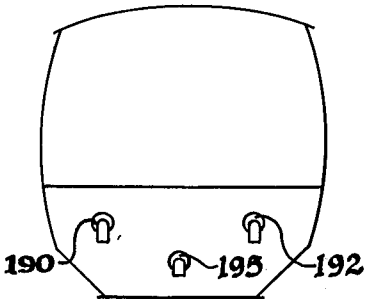
FIG. 8A is a sectional view along the lines 8A—8A in FIG. 8.

Furthermore, for very difficult unloading materials which bridge both low down in the hopper and high in the hopper, and tend to cling to the side of the car, as shown in FIGS. 8, 8A and 8B it is preferred to provide a manual elbow 195 on the lower portion (lower $\frac{1}{3}$) of the slope sheet near the outlet and at least one and preferably two self rotating elbows (190 and 192) on the upper portion (upper $\frac{1}{2}$) of one of the slope sheets adjacent the outlet. Preferably, at least one and most preferably two are provided in the upper portion of each slope sheet. Note self rotating elbows 194 and 196 in FIG. 8B.

This arrangement is utilized for extremely difficult material, usually fibrous (examples of which are asbestos and some grades of wood flour) which exhibit severe arching tendencies, severe hang-up in valley angles and will bridge the discharge opening even in the loose or non-compacted state.

The manual elbow is directed down at the discharge opening to prevent precent lading from bridging the opening. It may also be rotated toward the lower part of the valleys. The self rotating elbows will dislodge the material which will hang-up on the transverse floor sheets, side slope sheets and the valley angles.

The embodiments of the invention in which an exclusive property or privilege is claimed are defined as follows:

1. An aerator control box for hopper unloading comprising:

a manifold having an inlet adapted to be connected to a source of compressed gas; said manifold including a first outlet having a first conduit connected thereto; said first conduit adapted to be placed in fluid communication with a first accumulator discharge valve adapted to pressurize and to discharge an accumulator in fluid communication therewith; at least one control assembly mounted adjacent said first conduit comprising at least one conduit valve in fluid communication with said first conduit and being movable between open and closed positions relative to said first conduit, and timing means for timing the inception of movement of said conduit valve between first and second positions; said first position venting said pressurized gas to atmosphere and allowing said first accumulator discharge valve to discharge said accumulator, and said second position adapted to pressurize said accumulator, and to maintain said first conduit in fluid communication with said first accumulator discharge valve; a second outlet from said manifold having an unobstructed second conduit adapted to be placed in continuous unobstructed fluid communication from said manifold to a second accumulator discharge valve also in fluid communication with an accumulator to apply compressed gas pressure to said second accumulator discharge valve to prevent said second accumulator discharge valve from discharging the accumulator in fluid communication therewith at any time while said first accumulator discharge valve is discharging.

2. An aerator system according to claim 1 wherein said timing means is a pneumatic timer.

3. An aerator system according to claim 1 wherein said timing means is an electronic timer.

4. An aerator system according to claim 1 wherein said timing means is an electro-mechanical timer.

5. An aerator control box according to claim 1 wherein said manifold is provided with a third outlet having a third conduit attached thereto; said third conduit adapted to be placed in fluid communication with a third accumulator discharge valve to pressurize and to control the discharge of an accumulator in fluid communication with said third accumulator discharge valve; a second control assembly mounted adjacent said third conduit; said second control assembly having a second conduit valve in fluid communication with said third conduit and being movable between said first and second positions relative to said third conduit; and second timing means for timing the inception of movement of said second conduit valve between said first and second positions; said first position venting said pressurized gas to atmosphere and allowing said third accumulator discharge valve to discharge an accumulator in fluid communication therewith; and said second position adapted to pressurize said accumulator and to maintain said conduit in fluid communication with said third accumulator discharge valve.

6. An aerator control box according to claim 5 wherein said manifold is provided with a fourth outlet having an unobstructed fourth conduit adapted to be placed in unobstructed continuous communication from said manifold to a fourth accumulator discharge valve to apply compressed gas pressure to said fourth accumulator discharge valve to prevent said fourth accumulator discharge valve from discharging an accumulator in fluid communication therewith at any time while said first and third accumulator discharge valves are discharging.

7. An aerator control box according to claim 1 wherein said control box is portable.

8. A railway hopper car comprising:

trucks supporting the car at opposite ends thereof; first and second hoppers spaced longitudinally along the car; each of said hoppers having slope sheets at the lower portion thereof extending downwardly to define a discharge opening; a discharge outlet mounted so as to be movable between open and closed positions relative to said discharge opening; each of said hoppers adapted to contain a difficult to unload lading; a gas accumulator located adjacent said hoppers; a first discharge device mounted for discharge into said first hopper and being in fluid communication with a first accumulator discharge valve in fluid communication with said gas accumulator; a second discharge device mounted on said second hopper in fluid communication with a second accumulator discharge valve in fluid communication with said gas accumulator: said first and second discharge valves adapted to control the pressurization and discharge of said gas accumulator; and a control arrangement for controlling the time sequence of discharge from each of said first and second accumulator discharge valves whereby to discharge said accumulator more than once through one of said first and second discharge devices in a predetermined time sequence into one of said hoppers to facilitate unloading or difficult to unload lading from said one hopper, while preventing discharge of said accumulator through the other of said first and second discharge devices into the other of said hoppers at any time when discharge is occuring through said one of said first and second discharge devices into said one hopper.

9. A railway hopper car according to claim 8 wherein said discharge device comprises a discharge conduit.

10. A railway hopper car according to claim 8 wherein said discharge device comprises a self rotating elbow.

11. A railway hopper car according to claim 8 wherein said discharge device comprises a manually rotating elbow.

12. A railway hopper car according to claim 9 wherein said discharge conduit discharges a blast of gas longitudinally of said car.

13. A railway hopper car according to claim 9 wherein said discharge conduit discharges a blast of gas transversely of said car.

14. A railway hopper car according to claim 8 wherein said control arrangement comprises a three way valve in communication with one of said accumulator discharge valves.

15. A railway hopper car according to claim 8 including at least two accumulators mounted on said car, each of said first and second discharge devices being in fluid communication with a first one of said accumulators and wherein a third discharge device is mounted for discharge into one of said hoppers and in fluid communication with the other one of said accumulators and wherein said control arrangement prevents discharge from said accumulators into one of said hoppers at any time while discharge is occuring from said accumulators into another of said hoppers.

16. A railway hopper car according to claim 15 wherein said accumulators are mounted transversely of the car under at least one of said hoppers.

17. A railway hopper car according to claim 16 wherein the number of accumulators mounted upon the car is one more than the number of hoppers.

18. A railway hopper car according to claim 10 wherein said self rotating elbow is located between about one-third and about two-thirds up at least one of said slope sheets.

19. A railway hopper car according to claim 18 wherein each slope sheet adjacent said outlet has mounted thereon a self indexing elbow mounted between about one-third and about two-thirds up said slope sheet.

20. A railway hopper car according to claim 11 wherein said manually rotating elbow is located in the lower one-third portion of at least one of said slope sheets adjacent said outlet.

21. A railway hopper car according to claim 20 wherein in addition to said manually indexing elbow, at least one self indexing elbow is mounted upon the upper portion of at least one of said slope sheets adjacent said outlet.

22. A railway hopper car according to claim 21 wherein each slope sheet adjacent said outlet has mounted thereon at least one self indexing elbow in the upper portion thereof.

23. A railway hopper car according to claim 22 wherein at least one of the slope sheets adjacent said outlet has mounted thereon at least two self indexing elbows in the upper portion thereof.

24. A railway hopper car according to claim 15 wherein a fourth discharge device is mounted for discharge into the other of said hoppers and wherein both of said accumulators have at least two discharge devices in fluid communication therewith and wherein each of the discharge devices in fluid communication with a given accumulator is mounted for discharge into a different one of said hoppers, and wherein said control arrangement prevents the discharge of discharge devices into one of said hoppers at any time while discharge is occuring into the other of said hoppers.

25. An aerator control arrangement comprising:

a manifold having an inlet adapted to be connected to a source of compressed gas; said manifold including a first outlet having a first conduit connected thereto, said first conduit being in fluid communication with a first accumulator discharge valve; said first accumulator discharge valve being in fluid communication with a first discharge device mounted on a vessel adapted to contain a difficult to unload lading, said first accumulator discharge valve also being in fluid communication with a compressed gas accumulator; a control assembly mounted adjacent said first conduit including a first conduit valve being movable between first and second positions relative to said first conduit, and timing means for timing the inception of movement of said first conduit valve between said first and second positions; said first position venting said pressurized gas to atmosphere and allowing said first accumulator discharge valve to discharge said accumulator through said first accumulator discharge valve and said first discharge device; said second position maintaining said first conduit in fluid communication with said first accumulator discharge valve and adapted to pressurize said accumulator; a second outlet from said manifold having an unobstructed second conduit attached to said second outlet; when the control arrangement is in use, said second conduit providing continuous unobstructed fluid communication from said manifold to said second accumulator discharge valve; said second accumulator discharge valve being in fluid communication with a second discharge device mounted on a vessel adapted to contain a difficult to unload lading, and in fluid communication with a compressed gas accumulator; the pressure of compressed gas in said second conduit preventing said second accumulator discharge valve and said second discharge device from discharging at any time while said first discharge device is discharging.

26. An aerator control arrangement according to claim 25 wherein said manifold is provided with a third outlet having a third conduit attached thereto; said third conduit being in fluid communication with a third accumulator discharge valve; said third accumulator discharge valve being in fluid communication with a third discharge device mounted on said vessel; a second control assembly mounted adjacent said third conduit; said second control assembly including a second conduit valve in fluid communication with said third conduit and being movable between first and second positions relative to said third conduit; said first position venting said pressurized gas to atmosphere, and adapted to discharge said third accumulator discharge valve; and said second position maintaining said third conduit in fluid communication with said third accumulator discharge valve to prevent discharge of an accumulator in communication therewith, and second timing means for timing the movement of said second conduit valve between said first and second positions to control the discharge of an accumulator in fluid communication with said third accumulator discharge valve.

27. An aerator control arrangement according to claim 26 wherein said manifold is provided with a fourth outlet having a fourth conduit adapted to be placed in continuous communication with a fourth accumulator discharge valve in fluid communication with a fourth discharge device mounted on a vessel adapted to contain a difficult to unload lading the pressure of said compressed gas preventing said fourth accumulator discharge valve from discharging an accumulator in fluid communication therewith at any time when said first and third accumulator discharge valves are discharging.

28. An aerator control arrangement according to claim 25 wherein said first and second discharge devices are mounted on the same vessel.

29. A hopper unloading system comprising:

a pair of hoppers located adjacent one another; each hopper having slope sheets extending downwardly to define a hopper discharge opening at the lower portion thereof; a discharge outlet movable between open and closed positions relative to said opening; a first discharge device mounted upon one of said hoppers; a first accumulator discharge valve in fluid communication with said first discharge device; a second discharge device mounted on the other of said hoppers; a second accumulator discharge valve being in fluid communication with said second discharge device; a gas accumulator mounted adjacent said hoppers; both of said first and second accumulator discharge valves being in fluid communication with said gas accumulator; each of said accumulator discharge valves adapted to control the pressurization and discharge of said gas accumulator to produce a blast of gas respectively through each of said discharge devices and into each of said hoppers; and a control arrangement for controlling the time sequence of discharge from each of said accumulator discharge valves whereby to discharge said accumulator more than once through one of said discharge devices in a predetermined time sequence into one of said hoppers to facilitate unloading of difficult to unload lading from said one hopper, while preventing discharge of said accumulator through the other of said discharge devices into the other of said hoppers at any time when discharge is occuring into said one hopper.

30. A hopper unloading system according to claim 29 wherein at least two accumulators are mounted adjacent said hoppers; each accumulator being in fluid communication with at least two discharge devices; each of said discharge devices respectively mounted on separate hoppers, and wherein the discharge devices in one of the hoppers are prevented from discharging by said control arrangement at any time while the discharge devices in the other of said hoppers are discharging.

31. A railway hopper car comprising:

trucks supporting the car at opposite ends thereof; first and second hoppers spaced longitudinall along the car; each of said hoppers having slope sheets at the lower portion thereof extending downwardly to define a discharge opening; a discharge outlet mounted so as to be movable between open and closed positions relative to said discharge opening; each of said hoppers adapted to contain a difficult to unload lading; a first discharge device mounted upon one of said hoppers; a second discharge device mounted upon the other of said hoppers; a first accumulator discharge valve in fluid communication with said first discharge device; a second accumulator discharge valve in fluid communication with said second discharge device; each of said first and second accumulator discharge valves being in fluid communication with a gas accumulator mounted adjacent said hoppers; each of said first and second accumulator discharge valves adapted to discharge a gas accumulator in communication therewith to produce a blast of gas respectively through each of said discharge devices and into each of said hoppers; and a control arrangement for controlling the time sequence of discharge from said first and second accumulator discharge valves comprising: a manifold having an inlet adapted to be connected to a source of compressed gas; said manifold including a first outlet having a first conduit connected thereto; said first conduit adapted to be placed in fluid communication with one of said first and second accumulator discharge valves; at least one control assembly mounted adjacent said first conduit comprising at least one conduit valve in fluid communication with said first conduit and being movable between open and closed positions relative to said first conduit, and timing means for timing the inception of movement of said conduit valve between first and second positions; said first position venting said pressurized gas to atmosphere and allowing said one of said first and second accumulator discharge valves to discharge an accumulator in communication therewith; and said second position adapted to pressurize said accumulator and maintain said first conduit in fluid communication with said one of said first and second accumulator discharge valves; a second outlet from said manifold having an unobstructed second conduit providing continuous unobstructed fluid communication from said manifold to the other of said first and second accumulator discharge valves to apply compressed gas pressure to said other of said first and second accumulator discharge valves to prevent said other of said first and second accumulator discharge valves from discharging an accumulator in communication therewith at any time while said one of said first and second accumulator discharge valves is discharging.

32. A railway hopper car according to claim 31 wherein said discharge devices are each in fluid communication with the same accumulator.

33. A railway hopper car according to claim 31 wherein said manifold is provided with a third outlet having a third conduit attached thereto; said third conduit adapted to be placed in fluid communication with a third accumulator discharge valve to pressurize and to control the discharge of an accumulator in fluid communication with said third accumulator discharge valve; a second control assembly mounted adjacent said third conduit; said second control assembly having a second conduit valve in fluid communication with said third conduit, and being movable between said first and second positions relative to said third conduit, and second timing means for timing the inception of movement of said second conduit valve between said first and second positions; said first position venting said pressurized gas to atmosphere and allowing said third accumulator discharge valve to discharge an accumulator in fluid communication therewith; and said second position adapted to pressurize said accumulator and to maintain said third conduit in fluid communication with said third accumulator discharge valve.

34. A railway hopper car according to claim 33 wherein said manifold is provided with a fourth outlet having an unobstructed fourth conduit adapted to be placed in unobstructed continuous communication from said manifold to a fourth accumulator discharge valve to apply compressed gas pressure to said fourth accumulator discharge valve to prevent said fourth accumulator discharge valve from discharging an accumulator in fluid communication therewith at any time while said first and third accumulator discharge valves are discharging.

35. A railway hopper car according to claim 31 wherein said first conduit further includes a least one quick release valve downstream of said first conduit valve adapted to vent said first conduit when said first conduit valve is vented to atmosphere.

36. A railway hopper car according to claim 34 wherein said third conduit further includes at least one quick release valve downstream of said second conduit valve adapted to vent said third conduit when said second conduit valve is vented to atmosphere.

37. A hopper unloading system comprising:

a plurality of hoppers located adjacent one another; each hopper having slope sheets extending downwardly to define a hopper discharge opening at the lower portion thereof; a discarge outlet movable between open and closed positions relative to said opening; a first discharge device mounted upon one of said hoppers, and a second discharge device mounted upon the other of said hoppers; a first accumulator discharge valve in fluid communication with first said discharge device; a second accumulator discharge valve in fluid communication with said second discharge evice; each of said first and second accumulator discharge valves also being in fluid communication with a gas accumulator mounted adjacent said hoppers; each of said first and second accumulator discharge valves adapted to discharge a blast of gas respectively through each of said discharge devices and into each of said hoppers; and a control arrangement for controlling the time sequence of discharge from each of said first and second accumulator discharge valves comprising: a manifold having an inlet adapted to be connected to a source of compressed gas; said manifold including a first outlet having a first conduit connected thereto; said first conduit adapted to be placed in fluid communication with one of said first and second accumulator discharge valves; at least one control assembly mounted adjacent said first conduit comprising at least one conduit valve in fluid communication with said first conduit and being movable between open and closed positions relative to said first conduit, and timing means for timing the inception of movement of said conduit valve between first and second positions; said first position venting said pressurized gas to atmosphere and allowing said one of said first and second accumulator discharge valves to discharge an accumulator in communication therewith; said second position adapted to pressurize an accumulator in communication therewith, and maintain said first conduit in fluid communication with said one of said first and second accumulator discharge valves; a second outlet from said manifold having an unobstructed second conduit when in use providing continuous unobstructed fluid communication from said manifold to the other of said first and second accumulator discharge valves to apply compressed gas pressure to said other of said first and second accumulator discharge valves to prevent said other accumulator discharge valve from discharging an accumulator in fluid communication therewith at any time while said first accumulator discharge valve is discharging.

38. A hopper unloading system according to claim 37 wherein each of said first and second accumulator discharge valves are in fluid communication with the same accumulator.

39. A hopper unloading system according to claim 37 wherein said first conduit further includes a quick release valve downstream of said first conduit valve adapted to vent said first conduit when said first conduit valve is vented to atmosphere.

40. An aerator control box for hopper unloading comprising:

a manifold having an inlet adapted to be connected to a source of compressed gas; said manifold including a first outlet having a first conduit connected thereto; said first conduit adapted to be placed in fluid communication with a first accumulator discharge valve adapted to pressurize and to discharge an accumulator in fluid communication therewith; at least one control assembly mounted adjacent said first conduit comprising at least one conduit valve in fluid communication with said first conduit and being movable between first and second positions relative to said first conduit, and timing means for timing the inception of movement of said conduit valve between first and second positions; said first position venting said pressurized gas to atmosphere and allowing said first accumulator discharge valve to discharge said accumulator, and said second position adapted to pressurize said accumulator and to maintain said first conduit in fluid communication with said first accumulator discharge valve; said first conduit further including at least one quick release valve downstream of said first conduit valve adapted to vent said first conduit when said first conduit valve is vented to atmosphere; a second outlet from said manifold having an unobstructed second conduit adapted to be placed in continuous unobstructed fluid communication from said manifold to a second accumulator discharge valve also in fluid communication with an accumulator to apply compressed gas pressure to said second accumulator discharge valve to prevent said second accumulator discharge valve from discharging the accumulator in fluid communication therewith at any time while said first accumulator discharge valve is discharging.

41. An aerator control box according to claim 40 wherein said manifold is provided with a third outlet having a third conduit attached thereto; said third conduit adapted to be placed in fluid communication with a third accumulator dscharge valve to pressurize and to control the discharge of an accumulator in fluid communication with said third accumulator discharge valve; a second control assembly mounted adjacent said third conduit; said second control assembly having a second conduit valve in fluid communication with said third conduit and being movable between said first and second positions relative to said third conduit; and second timing means for timing the inception of movement of said second conduit valve between said first and second positions; said first position venting said pressurized gas to atmosphere and allowing said third accumulator discharge valve to discharge an accumulator in fluid communication therewith; and said second position adapted to pressurize said accumulator and to maintain said third conduit in fluid communication with said third accumulator discharge valve; said third conduit further including at least one quick release valve downstream of said second conduit valve adapted to vent said third conduit when said second conduit valve is vented to atmosphere.

42. An aerator control arrangement comprising: a manifold having an inlet adapted to be connected to a source of compressed gas; said manifold including a first outlet having a first conduit connected thereto, said first conduit being in fluid communication with a first accumulator discharge valve; said first accumulator discharge valve being in fluid communication with a first discharge device mounted on a vessel adapte to contain a difficult to unload lading, said first accumulator discharge valve also being in fluid communication with a compressed gas accumulator; a control assembly mounted adjacent said first conduit including a first conduit valve being movable between first and second positions relative to said first conduit, and timing means for timing the inception of movement of said frst conduit valve between first and second positions; said first position venting said pressurized gas to atmosphere and allowing said first accumulator discharge valve to discharge said accumulator through said first accumulator discharge valve and said first discharge device; said second position maintaining said first conduit in fluid communication with said first accumulator discharge valve and adapted to pressurize said accumulator; said first conduit further including a quick release valve downstream of said first conduit valve adapted to vent said first conduit when said first conduit valve is vented to atmosphere; a second outlet from said manifold having an unobstructed second conduit attached to said second outlet; when the control arrangement is in use, said second conduit providing continuous unobstructed fluid communication from said manifold to said second accumulator discharge valve; said second accumulator discharge valve being in fluid communication with a second discharge device mounted on a vessel adapted to contain a difficult to unload lading, and in fluid communication with a compressed gas accumulator; the pressure of compressed gas in said second conduit preventing said second accumulator discharge valve and said second discharge device from discharging at any time while said first discharge device is discharging.

43. An aerator control arrangement according to claim 42 wherein said manifold is provided with a third outlet having a third conduit attached thereto; said third conduit being in fluid communication with a third accumulator discharge valve; said third accumulator discharge valve being in fluid communication with a third discharge device mounted on said vessel; a second control assembly mounted adjacent said third conduit; said second control assembly including a second conduit valve in fluid communication with said third conduit and being movable between first and second positions relative to said third conduit; said first position venting said pressurized gas to atmosphere, and adapted to discharge said third accumulator discharge valve; and said second position maintaining said third conduit in fluid communication with said third accumulator discharge valve to prevent discharge of an accumulator in communication therewith, and second timing means for timing the movement of said second conduit valve between said first and second positions to control the discharge of an accumulator in fluid communication with said third accumulator discharge valve; said third conduit further including a quick release valve downstream of said second conduit valve adapted to vent said third conduit when said second conduit valve is vented to atmosphere.

* * * * *

UNITED STATES PATENT AND TRADEMARK OFFICE

CERTIFICATE OF CORRECTION

PATENT NO. : 4,165,820

DATED : August 28, 1979

INVENTOR(S) : Richard H. Dugge and Dallas W. Rollins

It is certified that error appears in the above-identified patent and that said Letters Patent are hereby corrected as shown below:

Col. 1, line 34, after "relation", insert --with-- .
Col. 3, line 41, change "3" to read --32--.
Col. 4, line 3, change "thee" to read --these--.
line 12, after "accumulator" insert --56--.
line 54, after "110" insert a comma.
Col. 7, line 54, change "Perferably" to --Preferably--.
Col. 8, line 4, after "8B", insert a comma.
line 20, delete "precent".
Col. 11, claim 24, line 4, change "occuring" to --occurring--.
Col. 12, claim 31, line 59, change "longitudinall" to --longitudinally--.
Col. 14, claim 37, line 29, change "discarge" to --discharge--.
line 37, change "evice" to --device--.
Col. 16, claim 42, line 23, change "adapte" to --adapted--.
line 30, change "frst" to --first--.

Signed and Sealed this

*Fourth* Day of *December 1979*

[SEAL]

*Attest:*

SIDNEY A. DIAMOND

*Attesting Officer*

*Commissioner of Patents and Trademarks*